United States Patent [19]

Engstrom

[11] 4,193,459

[45] Mar. 18, 1980

[54] POST-HOLE DRIVER

[76] Inventor: William J. Engstrom, 5608 E. 96th St., Puyallup, Wash. 98371

[21] Appl. No.: 884,138

[22] Filed: Mar. 7, 1978

[51] Int. Cl.[2] ..... E21C 11/02; E21B 11/02

[52] U.S. Cl. ..... 173/43; 173/28; 173/127; 175/19; 405/245

[58] Field of Search ..... 173/28, 42, 43, 112, 173/114, 115, 116, 124, 38, 127; 175/19; 405/245, 246, 247

[56] References Cited

U.S. PATENT DOCUMENTS

| | | | |
|---|---|---|---|
| 2,410,508 | 11/1946 | Lamme | 173/38 |
| 3,452,829 | 7/1969 | Smith | 173/28 |
| 3,548,604 | 12/1970 | Campbell | 173/28 |
| 3,700,047 | 10/1972 | Gartner | 173/124 |
| 3,838,741 | 10/1974 | Pepe | 173/128 |
| 3,961,672 | 6/1976 | Welsch et al. | 173/119 |
| 4,002,210 | 1/1977 | White | 173/42 |
| 4,050,526 | 9/1977 | Deike | 173/28 |
| 4,130,168 | 12/1978 | Deike | 173/43 X |

FOREIGN PATENT DOCUMENTS

| | | | |
|---|---|---|---|
| 1430159 | 3/1976 | United Kingdom | 173/127 |
| 296868 | 3/1972 | U.S.S.R. | 175/19 |

*Primary Examiner*—Lawrence J. Staab
*Attorney, Agent, or Firm*—Eugene D. Farley

[57] ABSTRACT

A vehicle-supported post-hole driver comprises a frame adapted to be mounted on the pivot of the vehicle drawbar. It is supported in a fore-and-aft position by a fluid cylinder connected between the frame and the support vehicle, the fluid cylinder providing for fore-and-aft movement of the outboard end of the frame. A second fluid cylinder pivots the frame about the drawbar pivot thereby transversely positioning the outboard end of the frame. The outboard end of the frame supports a pivotally-mounted yoke into which a pivotally-mounted vertical guide bearing is positioned. The combination of the pivoted yoke and the pivoted guide bearing provides a gimbaled arrangement. Slideably positioned in the guide bearing is a vertical shaft to which is attached a drive hammer and post-hole bit assembly. The drive hammer is raised relative to the post-hole bit by means of a fluid cylinder mounted within the bit and connected to the drive hammer. It drops gravitationally and drives the bit into the ground.

5 Claims, 7 Drawing Figures

POST-HOLE DRIVER

BACKGROUND AND GENERAL STATEMENT OF THE INVENTION

My invention pertains to apparatus for driving in the ground post-holes adapted to receive conventional posts of various materials such as precast concrete and of a configuration and composition not adaptable to being directly driven into the ground.

Posts that are driven into the ground are limited in bearing area by the size of the post and the depth to which they are driven. Posts that are set in previously prepared holes are adapted to have their effective bearing area increased either through the use of concrete or loose aggregate tamped firmly between the post and the ground. Such holes normally are dug either manually or by power-driven augers mounted on a vehicle. Both methods result in the production of loose material which, if used to fill the space between the post and the hole wall, results in the bearing area limitation referred to in connection with driven posts. Alternatively, it is necessary to remove the loose material from the site.

A need exists for apparatus readily adapted to the terrain which will rapidly dig post holes of a size larger than the post.

Typical prior art pertains to post drivers, rather than to post-hole drivers. A post driver using a fluid cylinder to raise a driving weight in which the weight returns the piston to its original position is shown in U.S. Pat. No. 2,940,267 to Shaver and U.S. Pat. No. 2,659,583 to Dorkins. The patent to Welsch et al U.S. Pat. No. 3,961,672 discloses lateral and fore-and-aft positioning of an impact hammer relative to a support.

However, presently available post-hole apparatus is cumbersome to position and align in the fore-and-aft, lateral and vertical positions, resulting in a tedious and costly operation. There is a need for post-hole driving apparatus that is easily attached and removed from the support vehicle. Such post-hole driving apparatus must be capable of rapid locating and alignment without the need for precision positioning of the vehicle. The post-hole driving apparatus must drive a vertical post-hole with the support vehicle on sloping terrain. The post-hole driver must be free of damage by engagement with subterranean objects. It is the general object of this invention to provide apparatus which may be rapidly positioned and which will produce vertical post-holes.

Another object of the invention is to provide post-hole driving apparatus that is readily attached to and removed from conventional vehicle equipment.

Another object of the invention is to provide post-hole driving apparatus that permits precision positioning of the post-hole driver without the need for precise positioning of the support vehicle.

Another object of the invention is to provide post-hole driving apparatus that will drive a vertical hole with the support vehicle on sloping terrain.

Another object of the invention is to provide post-hole driving apparatus that assures the driving of a vertical hole.

Another object of the invention is to provide post-hole driving apparatus which in use will not be damaged by contact with rocks and other subterranean objects.

Another object of the invention is to provide post-hole driving apparatus that is easily removed from the finished hole.

Another object of the invention is to provide post-hole driving apparatus that drives a hole providing for increased post-bearing area on the ground.

Another object of the invention is to provide post-hole driving apparatus that produces a tapered hole.

Another object of the invention is to provide post-hole driving apparatus in which the drive hammer is cycled automatically.

Broadly considered, the foregoing and other objects of this invention are accomplished by pivotally mounting a frame on the drawbar of a vehicle with the frame supported in a fore-and-aft position by a fluid cylinder connecting the frame to the vehicle. A second fluid cylinder provides for pivotal positioning of the frame relative to the vehicle drawbar, thereby moving the free or outboard end of the frame transversely. The frame is provided at its outboard end with a pivotally mounted yoke having the pivots transverse to the frame providing for fore-and-aft pivoting of the yoke.

Pivotally mounted on the yoke is a bearing through which the support shaft for the post-hole bit assembly is slideably positioned and adapted to be locked in a raised position. The pivotally mounted yoke and the pivotally mounted bearing are dampened against rapid movement by shock absorber means. The post-hole bit together with a drive hammer are an integral part of an assembly which includes a slide guide for the drive hammer. Mounted within the driving bit is a single-acting cylinder and piston which raises the drive hammer and, upon release of the fluid pressure, permits the hammer to drop, driving the bit into the ground.

These and other objects of the invention are achieved by the construction arrangement illustrated in the accompanying drawings and described herein.

BRIEF DESCRIPTION OF THE DRAWINGS AND PREFERRED EMBODIMENTS

Figures 1, 6, 7:
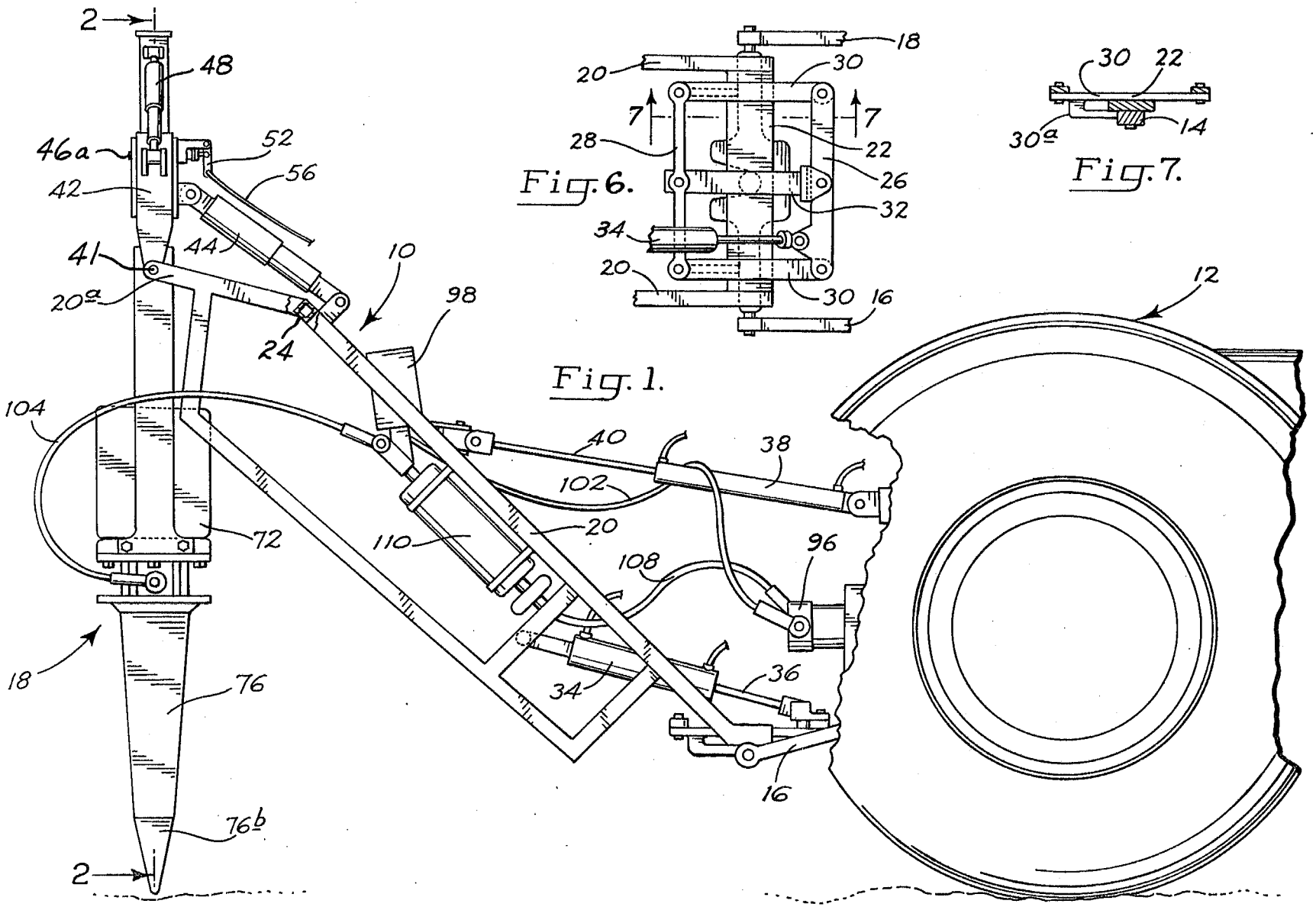
FIG. 1 is a side elevation view of the herein described post-hole driving apparatus including a portion of the associated vehicle.
FIG. 6 is a plan view of the frame-to-vehicle pivoting linkage.
FIG. 7 is a sectional elevation view along the line 7—7 of FIG. 6.

The post-hole driver FIG. 1 comprises a frame 10 in association with a vehicle 12 in the form of a tractor having a drawbar 14 FIG. 7 pivotally supported on arms 16 FIG. 6 and a post-hole bit assembly 18 FIG. 1.

The frame 10 comprises side members 20 FIG. 1 joined at their lower ends by crossbar 22 FIG. 6 and at their upper ends by crossbar 24 FIG. 1. Supported on frame crossbar 22 is a parallelogram linkage having transverse members 26 and 28, a pair of longitudinal end members 30 and central longitudinal member 32. The central member 32 is pivotally engaged with the frame crossbar 22 and the drawbar 14. The longitudinal end members 30 are provided with a bracket **30*a* FIG. 7** adapted to engage the drawbar 14 below the crossbar 22.

The transverse member 26 is connected near the lower end to the frame 10 by means of fluid cylinder 34 and piston rod 36 providing fluid power to rotate the crossbar 22 relative to drawbar 14 thereby swinging the outboard end of the frame 10 transverse to its longitudinal axis. The frame 10 is further connected to the tractor 12 by means of fluid cylinder 38 and piston rod 40 providing for moving the outboard end of the frame 10 in a forward and aft or longitudinal direction with simultaneous up and down movement.

Figure 2:
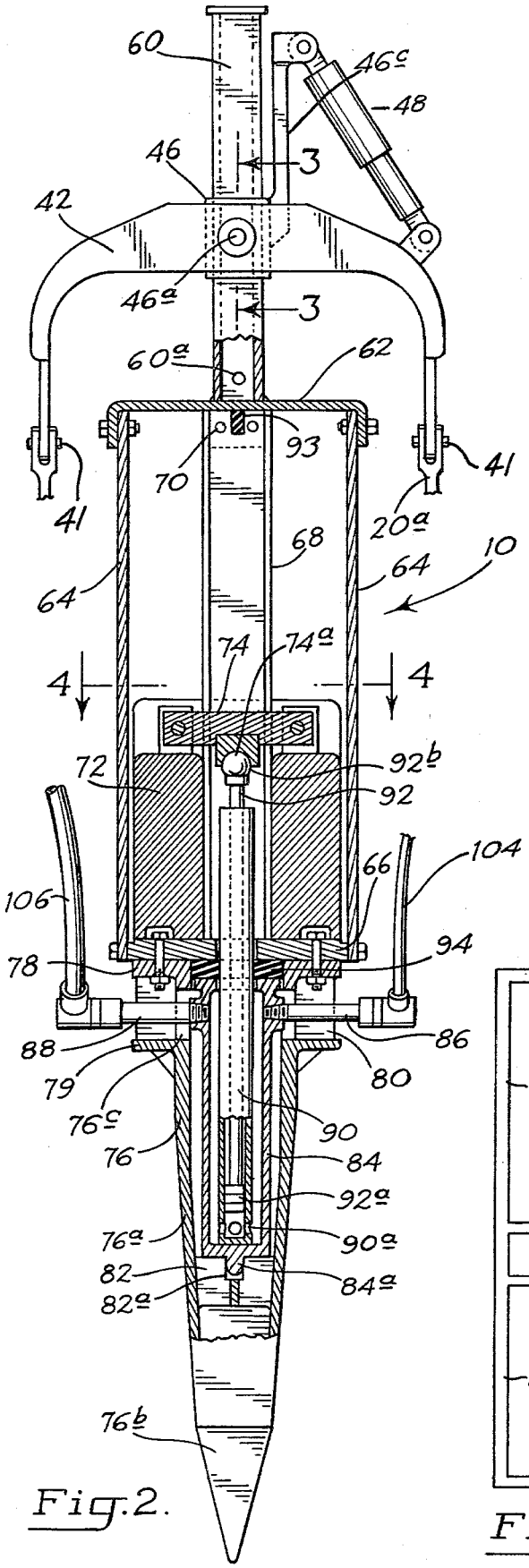
FIG. 2 is a partial sectional elevational view along the line 2—2 of FIG. 1.

Pivotally mounted on the outboard ends 20*a* of side members 20 FIGS. 1 and 2, by pivots 41, is a yoke 42. The yoke 42 is prevented from rapid position changing relative to the frame 10 by further attachment to the frame by means of shock absorber 44. Pivotally mounted within the yoke 42 between side members 42*a* and 42*b* is a square bearing 46 FIG. 3 having trunnions 46*a* and 46*b*. The bearing 46 is provided with an upwardly extending arm 46*c* FIG. 2 and joined to the yoke 42 by means of shock absorber 48 to prevent rapid swinging of the pivoted bearing 46.

The trunnion 46*b* is provided with a hole adapted to receive a plunger pin 50 connected to the yoke 42 through a lever 52. The spring 54 forces plunger pin 50 into engagement with square shaft 60 slideably mounted in the bearing 46. The lever 52 is provided with a pull cord 56 for withdrawal of the plunger pin 50 against the force of the spring 54.

The post-hole bit assembly 18 is slideably supported in pivoted bearing 46 by the square shaft 60 and locked in a raised position by engagement of the plunger pin 50 with the hole 60*a* in shaft 60. Secured to the lower end of the shaft 60 is cap bar 62 bolted to side members 64 secured to drive plate 66.

Figure 4:
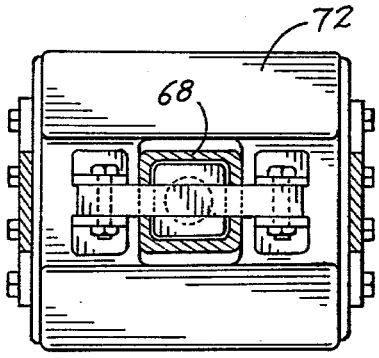
FIG. 4 is a plan sectional view along the line 4—4 of FIG. 2.

Positioned between the drive plate 66 and the cap bar 62 is a slotted, hollow, square guide 68 attached to the drive plate 66 and bolt-connected to the cap bar 62 by bolts 70. Slideably mounted around the guide 68 is a reciprocating drive hammer 72 FIGS. 2 and 4. Extending through the slot of guide 68 is crossbar 74 connected at each end with the drive hammer 72 and provided with an open ball socket 74*a* FIG. 2.

Bolt-attached to the drive plate 66 is hollow bit 76 having tapered upper side portions 76*a* and a pointed end 76*b*. The upper end of the bit 76 is provided with outward projecting flange 78 providing attachment to the drive plate 66 and reinforcing flange 79 joined by vertical webs 80 on each side of the openings 76*c*.

Secured within the hollow bit 76 is a plug 82 having a central socket 82*a*. Mounted within the hollow bit 76 is a cylindrical fluid chamber 84 provided with inlet fluid connection 86 and outlet fluid connection 88. The lower end of the fluid chamber 84 is provided with a projection 84*a* adapted to engage the socket 82*a* in plug 82. Positioned within the fluid chamber 84 is a fluid cylinder 90 welded to the upper end member of the chamber 84 and projecting upwardly through the drive plate 66 into square guide 68. The lower end of the cylinder 90 is provided with fluid openings 90*a* for admission and discharge of fluid to the cylinder.

Within the cylinder 90 is piston rod 92 having piston 92*a* at its lower end and a ball 92*b* at its upper end adapted to engage with socket 74*a* of bar 74, the fluid cylinder-piston assembly being adapted to raise the drive hammer 72 to its uppermost position engaging resilient stop 93 on cap bar 62. Between the upper end wall of chamber 84 and drive plate 66 is resilient material 94 to absorb the inertia shock of the fluid chamber cylinder assembly when drive hammer 72 strikes drive plate 66.

Figure 5:
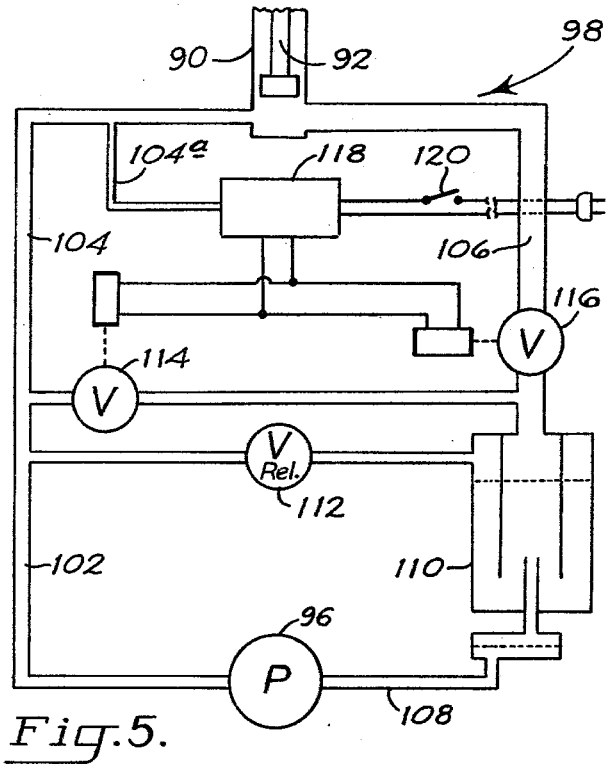
FIG. 5 is a schematic layout of the hydraulic and electrical system.

Fluid power to the fluid chamber 84 provided by tractor-mounted pump 96 FIG. 1 and fluid return from the fluid chamber 84 and cylinder 90 are through control assembly 98 by means of hydraulic lines 102, 104, 106 and 108. The control assembly 98 shown schematically in FIG. 5 provides automatic cycling of the piston rod 92 and drive hammer 72 by the pump 96 receiving fluid from the storage chamber 110 through line 108 pressurizing line 102 to the control assembly 98.

Within the control assembly 98 is a relief valve 112 set to establish the maximum pressure to be applied to the cylinder 90 returning the fluid to the chamber 110 when pressure is exceeded. With the high pressure valve 114 and return pressure valve 116 closed, high pressure is fed to the chamber 84 through line 104 into cylinder 90, raising drive hammer 72.

When the drive hammer 72 engages resilient stop 93 on cap bar 62 the pressure in line 104 will exceed the setting of a pressure switch supplied by line 104*a* within the electrical control unit 118. The closing of the pressure switch energizes and opens solenoid valves 114 and 116 permitting fluid to return to the chamber 110 through both fluid lines 104 and 106 as the drive hammer forces the piston rod 92 downward during its dropping action. The pressure in line 104 lowered by the opening of valves 114 and 116 would normally cause solenoid valves 114 and 116 to close. This is prevented from occurring until the drive hammer strikes drive plate 66 by a time delay in the control unit 118. At the end of the time delay valves 114 and 116 are closed, causing the cycle to repeat.

Fluid power for the frame positioning fluid cylinders 34 and 38 is obtained from the pump operated through controls that normally function with equipment used with the vehicle 12.

OPERATION

Figure 3:
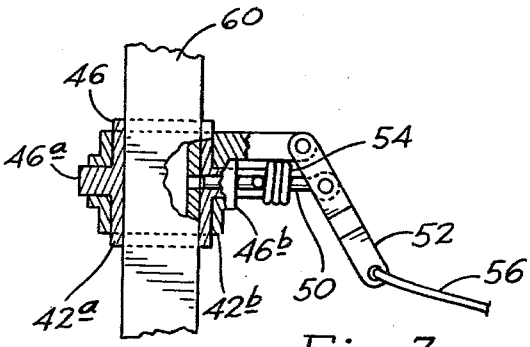
FIG. 3 is a cross-sectional elevational view along the line 3—3 of FIG. 2.

In the transport mode the post-hole bit assembly 18 is locked to the frame 10 by the engagement of the plunger pin 50 FIG. 3 with hole 60*a* in shaft 60. Energizing fluid cylinder 38 to retract piston rod 40 to its fully retracted position raises the post-hole bit assembly 18 free of the ground, permitting movement of the vehicle and post-hole apparatus.

Upon reaching the location at which a post-hole is to be driven, fluid cylinder 38 is operated to position the point 76*b* of bit 76 suspended a short distance above the ground. The tractor is then maneuvered to place the bit point 76*b* in an approximate position relative to the location for the post-hole. Should the vehicle be out of line with respect to the established post-hole line, activation of fluid cylinder 38 will move the bit 76 in a fore-and-aft and simultaneous up and down direction while activation of fluid cylinder 34 swings the bit in a transverse direction, thereby providing for precise location of the bit at the designated position for the post-hole. Independent of the slope of the terrain on which the support vehicle is positioned, the post-hole bit assembly 18 suspends vertically by reason of the pivotal mounting of the yoke 42 and guide bearing 46 thereby assuring a vertical position of the post-hole bit assembly 18. Plunger pin 50 is then withdrawn from shaft 60 by the operator's pulling cord 56 dropping the point 76*b* of bit 76 at the desired post-hole location and establishing the vertical alignment of the bit assembly.

Control unit 118 FIG. 5 is then energized by closing switch 120 causing solenoid valves 114 and 116 to close, permitting high pressure fluid to enter chamber 84 FIG. 2 and cylinder 90, raising piston rod 92 and drive hammer 72 into engagement with stop 93 on cap bar 62. Thereafter increased pressure in fluid line 104 causes the control unit 118 to open solenoid valves 114 and 116. This causes the drive hammer to drop, striking drive plate 66 and driving bit 76 into the ground. The cycle repeats as previously explained until the bit is driven to the desired depth, normally against flange 79.

Should the bit 76 encounter a subterranean object, the tapered point 76*b* in conjunction with sloping sides 76*a* forces the subterranean object aside, maintaining the post-hole in the desired location.

Upon completion of the driving operation fluid cylinder 38 is energized to lower yoke 42 with its pivotally mounted guide bearing 46 along shaft 60 until plunger pin 50 engages with hole 60*a* in the shaft 60. The fluid cylinder 38 is then energized in the opposite direction to lift the frame and post-hole bit assembly 18 raising the bit from the post-hole. The entire apparatus is then moved to the next post-hole location and the sequence repeated.

Having thus described my invention in preferred embodiments, I claim:

1. A post hole driver comprising:

(a) an elongated frame, (b) frame mounting means comprising a draw bar arranged for attachment to a vehicle for pivotal movement about a horizontal axis relative to the vehicle, a cross bar connected to said one end of the frame and mounted on the draw bar for pivotal movement about an axis perpendicular to said horizontal axis, first extensible power means arranged to be connected at one end to the vehicle and at the opposite end to the frame for pivoting the latter about said horizontal axis, and second power means operatively interengaging the frame and draw bar for pivoting the frame about said perpendicular axis, (c) universal pivot means comprising a yoke member connected pivotally to the said opposite end of the frame on a pivot axis extending transversely of the frame, and a bearing member connected pivotally to the yoke member on a pivot axis extending transversely of the frame and perpendicular to the first named pivot axis, (d) an elongated shaft supported by the bearing member, (e) a reciprocating drive hammer, (f) a reciprocating drive hammer guide extending downward from the shaft guiding the hammer, (g) an elongated hollow bit extending downward from the drive hammer and dimensioned to penetrate the ground to the desired depth of a post hole, (h) an extensible fluid pressure piston-cylinder unit in the hollow bit engaging the drive hammer for alternately lifting and dropping the latter, (i) the assembly of shaft, hammer, hammer guide and bit being suspended by the bearing member and yoke by gravity, whereby to position the bit for forming a vertical post hole in the ground irrespective of the angular disposition of the vehicle, (j) a first shock absorber interconnecting the frame and yoke for resisting movement of the yoke relative to the frame, (k) a second shock absorber interconnecting the bearing member and yoke for resisting movement of the bearing member relative to the yoke, and (l) latch means releasably interengaging the bearing member and the shaft and operable upon release to allow the bit to move downward by gravity for engagement of its lower end with the ground.

2. A post hole former comprising:

(a) an elongated frame, (b) mounting means for mounting one end of the frame on a vehicle for movement of the opposite end of the frame laterally and up and down relative to and toward and away from the vehicle, the mounting means comprising a draw bar arranged for attachment to a vehicle for pivotal movement about a horizontal axis relative to the vehicle, a cross bar connected to said one end of the frame and mounted on the draw bar for pivotal movement about an axis perpendicular to said horizontal axis, first extensible power means arranged to be connected at one end to the vehicle and at the opposite end to the frame for pivoting the latter about said horizontal axis, and second power means operatively interengaging the frame and draw bar for pivoting the frame about said perpendicular axis, (c) post hole forming means for forming a post hole in the ground, and (d) universal pivot means interconnecting the said opposite end of the frame and the post hole forming means for suspending the latter from the frame by gravity, whereby to position the post hole forming means for forming a vertical post hole in the ground irrespective of the angular disposition of the vehicle.

3. The post hole former of claim 2 including a parallelogram linkage pivotally interengaging the draw bar and the end of the second power means opposite the frame.

4. A post hole former comprising:

(a) an elongated frame, (b) mounting means for mounting one end of the frame on a vehicle for movement of the opposite end of the frame laterally and up and down relative to and toward and away from the vehicle, (c) post hole forming means for forming a post hole in the ground, and (d) universal pivot means interconnecting the said opposite end of the frame and the post hole forming means for suspending the latter from the frame by gravity, whereby to position the post hole forming means for forming a vertical post hole in the ground irrespective of the angular disposition of the vehicle, the universal pivot means comprising a yoke member connected pivotally to the said opposite end of the frame on a pivot axis extending transversely of the frame, and a bearing member connected pivotally to the yoke member on a pivot axis extending transversely of the frame and perpendicular to the first named pivot axis, the bearing member supporting the post hole forming means, and (e) latch means releasably interengaging the bearing member and post hole forming means and operable upon release to allow the post hole forming means to move downward by gravity for engagement of its lower end with the ground.

5. A post hole former comprising:

(a) an elongated frame, (b) mounting means for mounting one end of the frame on a vehicle for movement of the opposite end of the frame laterally and up and down relative to and toward and away from the vehicle, (c) post hole forming means for forming a post hole in the ground, and (d) universal pivot means interconnecting the said opposite end of the frame and the post hole forming means for suspending the latter from the frame by gravity, whereby to position the post hole forming means for forming a vertical post hole in the ground irrespective of the angular disposition of the vehicle, (e) the post hole forming means being a post hole driver comprising (1) an elongated shaft supported by the universal pivot means, (2) a reciprocating drive hammer, (3) a reciprocating drive hammer guide extending downward from the shaft for guiding the hammer, (4) an elongated hollow bit extending downward from the drive hammer and dimensioned to penetrate the ground to the desired depth of a post hole, and (5) an extensible fluid pressure piston-cylinder unit in the hollow bit engaging the drive hammer for alternately lifting and dropping the latter.

* * * * *